US009039869B2

(12) United States Patent
Kim et al.

(10) Patent No.: US 9,039,869 B2
(45) Date of Patent: May 26, 2015

(54) CONTROLLABLE AIR DUCTS FOR FEEDING OF ADDITIONAL COMBUSTION AIR INTO THE AREA OF FLUE GAS CHANNELS OF COKE OVEN CHAMBERS

(75) Inventors: Ronald Kim, Essen (DE); Ralf Schumacher, Hagen (DE)

(73) Assignee: UHDE GMBH, Dortmund (DE)

( * ) Notice: Subject to any disclaimer, the term of this patent is extended or adjusted under 35 U.S.C. 154(b) by 1133 days.

(21) Appl. No.: 12/735,128

(22) PCT Filed: Dec. 4, 2008

(86) PCT No.: PCT/EP2008/010243

§ 371 (c)(1),
(2), (4) Date: Nov. 12, 2010

(87) PCT Pub. No.: WO2009/077082

PCT Pub. Date: Jun. 25, 2009

(65) Prior Publication Data

US 2011/0048917 A1 Mar. 3, 2011

(30) Foreign Application Priority Data

Dec. 18, 2007 (DE) ..... 10 2007 061 502

(51) Int. Cl.
*C10B 15/02* (2006.01)
*C10B 21/10* (2006.01)
*C10B 41/00* (2006.01)

(52) U.S. Cl.
CPC ..... *C10B 15/02* (2013.01); *C10B 21/10* (2013.01); *C10B 41/00* (2013.01)

(58) Field of Classification Search
CPC ..... C10B 15/02; C10B 21/10; C10B 41/00
USPC ..... 201/27, 15; 202/135, 145, 151
See application file for complete search history.

(56) References Cited

U.S. PATENT DOCUMENTS 4,287,024 A * 9/1981 Thompson ..... 202/135
6,187,148 B1 2/2001 Sturgulewski
(Continued)

FOREIGN PATENT DOCUMENTS

DE 10 2005 055 483 A1 5/2007
DE 10 2006 004 669 A1 8/2007
(Continued)

OTHER PUBLICATIONS

Walter E. Buss et al; "Thyssen Still Otto/PACTI nonrecovery cokemaking system"; AISE, Iron and Steel Engineer; Jan. 1999; pp. 33-38; vol. 76, No. 1; Pittsburgh, PA.

*Primary Examiner* — Jill Warden
*Assistant Examiner* — Joye L Woodard
(74) *Attorney, Agent, or Firm* — Marshall & Melhorn, LLC

(57) ABSTRACT

A device for feeding and controlling secondary air from secondary air ducts into flue gas channels of horizontal coke oven chambers is shown. The flue gas channels are located underneath the coke oven chamber floor on which coal carbonization is realized. The flue gas channels serve for combustion of partly burnt coking gases from the coke oven chamber. The partly burnt gases are burnt with secondary air, thus heating the coke cake also from below to ensure even coal carbonization. Secondary air comes from the secondary air ducts connected to atmospheric air and to the flue gas channels. Controlling elements are mounted in the connecting channels between the flue gas channels and secondary air ducts which can precisely control the air flow into the flue gas channels. Thereby, it is possible to achieve a much more regular heating and heat distribution in coke oven chambers. The actual controlling devices in the connecting channels can be formed by turnable pipe sections, wall bricks, or metal flaps. It is particularly advantageous to utilize a hump-like facility (tabouret) which sits in the secondary air ducts and which is comprised of a tabouret plate with a central opening that is slid under the corresponding embranchment to regulate the gas stream. The controlling mechanism can be actuated manually, electrically, or pneumatically. Thereby, the controlling device can also be automated.

22 Claims, 11 Drawing Sheets

(56) References Cited

U.S. PATENT DOCUMENTS

| | | | |
|---|---|---|---|
| 2009/0032382 | A1 | 2/2009 | Schuecker et al. |
| 2009/0152092 | A1 | 6/2009 | Kim et al. |
| 2010/0025217 | A1 | 2/2010 | Schuecker et al. |

FOREIGN PATENT DOCUMENTS

| | | | |
|---|---|---|---|
| WO | WO 2006/103 043 | A1 | 10/2006 |
| WO | WO 2006/128 612 | A1 | 12/2006 |

* cited by examiner

CONTROLLABLE AIR DUCTS FOR FEEDING OF ADDITIONAL COMBUSTION AIR INTO THE AREA OF FLUE GAS CHANNELS OF COKE OVEN CHAMBERS

BACKGROUND

The present invention relates to a device for improved feeding of secondary combustion air into the area of flue gas channels of horizontal coke oven chambers. Secondary combustion air is supplied into the flue gas channels from secondary air ducts which are usually installed under the flue gas channels. The present invention also relates to a device for controlling the feed volume of secondary air from the secondary air ducts into the area of flue gas channels. Owing to the improved supply and control of secondary air into the flue gas channels, the control of heat distribution and the combustion of coking gases in "Heat-Recovery" or "Non-Recovery" coke oven chambers can be improved.

In most cases, coke oven chambers of the "Heat-Recovery" or "Non-Recovery" type are set-up in such a manner that coal carbonization is realized in a horizontally charged coke oven chamber which is sealed to air. During the carbonization of coal, coal by-products evolve which are captured in conventional horizontal coke ovens and passed on for further processing. Coal by-products are mainly composed of gases, carbon monoxide, carbon dioxide, and higher-grade hydrocarbons. To ensure adequate supply of carbonization heat, conventional coke ovens must be heated by combustion of externally supplied combustion gases. In "Non-Recovery" or "Heat-Recovery" type coke ovens, the coal by-products derived from the carbonization process are utilized as combustion gases to generate the combustion heat needed for coal carbonization. To achieve the most even possible heating-up of the coke cake from all sides, only part of the coking gases is burnt above the coke cake, and partly burnt coking gases are burnt completely only underneath the coke cake in what are called flue gas channels.

In technical terms, this is realized by directly heating the upper side of the coke cake in the oven space by heat transfer procedures resulting from combustion processes with supply of an sub-stoichiometric amount of air. Coal by-products thus developing during coal carbonization are discharged as coking gases into an oven free space located above the coke cake which is left non-charged when charging the coke oven chamber with coal. Located in the ceiling of the coke oven or in its lateral walls are openings through which a certain amount of air, i.e. the so-called primary air, can be supplied into the upper section of the coke oven. A partial amount of the coking gases is burnt with primary air so that these gases heat the coke cake sufficiently from above to ensure adequate coal carbonization. The openings for introduction of primary air may be both controlled and non-controlled. An example for a controlled supply of primary air is given in WO 2006128612 A1.

Partly burnt coking gases from coal carbonization are conducted through so-called "downcomer" channels which may be accommodated in coke oven chamber walls, coke oven chamber doors or even in the coke cake into the flue gas channels located underneath the coke oven chamber and also designated as sole heating flues. There, they are completely burnt with another amount of air, which is called secondary air. By combustion of the residual carbonization products, the coke cake is also heated from below, because a substantial amount of heat is created by this downstream combustion with secondary air in the flue gas channels. The bottom between flue gas channels and coke oven chamber is relatively thin to ensure good heat transfer from flue gas channels into the coke oven chamber. To optimally exploit the heat from secondary combustion, the flue gas channels frequently extend like a meander under the coke oven chamber floor. The flue gas channels may be available in simple form, but also in multiple form. The flue gas channels are closed at all sides towards the atmospheric environment. Flue gas is conducted via an additional channel into a flue gas stack.

Secondary air for combustion is conducted from below into the flue gas channels. Located underneath the flue gas channels is a secondary air duct comprised of an opening to the environment and serving for pre-warming of cool ambient air on the one hand and distributing supplied secondary air over the flue gas channel(s) on the other hand. Secondary air can be supplied in a controlled manner into the secondary air duct. Accordingly, flaps or valves may be provided at the air intake opening for secondary air at the external openings of the secondary air ducts. These control devices make it possible to adequately control the stoichiometry of supplied air. Though these flaps or valves would be sufficient for controlling the secondary air, cold air is conducted through these feeder devices into the secondary air ducts and, thereby, into the flue gas channel. Moreover, the required secondary air cannot be conducted to all points in the flue gas channel, but is distributed in a non-controlled manner after having passed through the flap to all points of the flue gas channel located under the coke oven chamber.

Therefore, there are configurations feeding air in a controlled manner through the "downcomer" channels into the coking gas. U.S. Pat. No. 6,187,148 B1 describes a horizontal chamber-type coke oven which can conduct air through an opening in laterally installed "downcomer channels" into the "downcomer" channels. Since the opening has a controlling device, the thermal gradient n the coke oven as well as the gas pressure in the interior of the coke oven chamber can be controlled. But it is not possible to selectively influence the temperature distribution and the thermal gradient in the interior of the flue gas channels under the coke oven chamber floor so as to generate based upon a controlled secondary combustion an even planar heating under the coke bed to be heated-up. And it is not possible either to control the stoichiometry of combustion in flue gas channels.

WO 2006103043 A1 describes a coke oven design according to which secondary air is conducted from secondary air ducts through connecting channels into the flue gas channel. These are so installed that secondary air is distributed via precisely selected positions in the flue gas channel. In this manner, secondary air is fed over the entire length of the flue gas channel rather than at one position of the flue gas channel. In principle, this can be realized at arbitrary positions spread over the flue gas channel which extends in form of a meander. These vertical connecting channels from the secondary air ducts to the flue gas channels are so configured that combustion can be realized.

The flaps in the external openings of the secondary air ducts can regulate the air admission in such a manner that the air volume of supplied secondary air is controllable. But it is not possible to distribute the volume of supplied secondary air punctually. And it is not possible either to control the volume of supplied secondary air at a distinct position of the flue gas channel. According to prior art in technology, a control of secondary air volume is only feasible via flaps at the external openings of secondary air ducts. By this approach, however, secondary air is fed in a non-controlled manner over the entire length of the flue gas channel. Consequently, some positions in the flue gas channel experience an excessive supply of secondary combustion air, while other positions remain short in supply. As a result, those positions with a supplied excessive volume of secondary combustion air experience a cooling-off or overheating, while those positions with an insufficient supply of combustion air experience incomplete combustion.

BRIEF SUMMARY OF THE INVENTION

It is therefore the task to provide a system that conducts secondary combustion air from the secondary air duct in a controlled manner to various positions of the flue gas channels. The supply and control shall be able to approach the individual vertical connecting channels between the secondary air duct and the flue gas channels either individually or collectively. It shall be manually operable, but also be able to be automated. By supplying secondary combustion air in a manner precisely controlled to a given point over the entire length of the flue gas channels, the heat distribution in these channels can be controlled much better. In this manner, it can also be prevented that the coking gas burns down incompletely at other positions and is thereby discharged in non-burnt status from the flue gas channel. By way of the present invention, it is intended to generate an even secondary planar heating in the flue gas channels underneath the coke bed aimed at shortening the required carbonization process and thus serving to the benefit of economic efficiency of the carbonization process of the "Heat-Recovery" or "Non-Recovery" type.

The present invention solves this problem by providing for a control device which is installed in at least one vertical connecting channel between the secondary air duct and the flue gas channel(s). The control can be performed for a unique time during commissioning of the coke oven battery, but it can also be performed continuously depending on the demand and regularity of the carbonization process. It can be performed at a connecting point between the secondary air duct and flue gas channels, but preferably it can also be performed at several connecting points between the secondary air duct and flue gas channels. The controlling devices are comprised of a control that can be performed via metal flaps, flaps in the brickwork or via slide bricks. These can be actuated both manually and electrically or pneumatically. Thereby, the controlling device can also be automatized. Depending on requirements, it is possible to approach the flue gas channels individually or collectively.

By way of the secondary air quantity control described hereinabove, which proportions secondary air punctually into the flue gas channels, the temperature distribution can be controlled over the entire flue gas channel(s). For example, a uniform temperature distribution over the coke oven chamber floor can be obtained thereby. The flame distribution, too, can be adjusted in this manner. But it is also possible to optimize combustion by supplying a precisely proportioned amount of air, thus achieving an optimal exploitation of the coking gas. On the whole, coal consumption will thereby be substantially reduced over the operating time of the coke oven chamber. In this manner it is also possible to implement a secondary area heating by way of which the coke oven chamber floor is arbitrarily and preferably controlled heated over its entire area. Finally, it is also possible to offset pressure differences in a better way which may occur in flue gas channels during combustion.

Claimed in particular is a device for carbonization of coal in a horizontal coke oven chamber, wherein

- the horizontal coke oven chamber in its upper part is provided with openings for admission of primary air by which part of the gases occurring during coal carbonization is burnt, and
- flue gas channel(s) closed towards the exterior is/are located underneath the coke oven chamber floor which collect(s) partly burnt gases from the carbonization process and burn these completely with further air, i.e. the so-called secondary air, and
- the coke oven chamber is comprised of so-called "downcomer" channels for discharge of partly burnt gases from the carbonization process which are integrated in the lateral coke oven chamber wall or in the coke oven chamber door or in the coke cake, with these "downcomer" channels connecting the coke oven chamber interior with the flue gas channels, and
- so-called secondary air ducts are located underneath the flue gas channels, said secondary air ducts being connected to atmospheric air and being vertically connected to the flue gas channels by at least one connecting channel and serving for admission of secondary air by which partly burnt gases from the carbonization process are completely burnt, and
- flue gas channels are connected to a flue gas collecting pipe located outside the coke oven, said collecting pipe conducting the flue gases to the exterior atmosphere surrounding the coke oven, and which are characterized in that

- at least one flue gas channel and the secondary air ducts are provided with a facility by way of which the gas stream between the flue gas channel and the secondary air duct can be calibrated and regulated, and
- a controllable secondary area heating is rendered possible with the controllable ventilating system under the flue gas channel.

The number of vertical connecting channels between the secondary air duct and the flue gas channels which are controllable can be arbitrary. It is possible to configure only one of the arbitrary multitude of connecting channels as a controllable channel. But it is possible to configure several connecting channels as controllable channels. Finally, it is also possible to configure all vertical connecting channels between the secondary air ducts and the flue gas channels as controllable channels.

The flue gas channels can be of an arbitrary configuration. Preferably, it is a channel extending like a meander under the coke oven chamber floor and closed towards the exterior and carrying waste gases into another waste gas flue destined for this purpose. But it may also be several flue gas channels. Hence it is also possible to provide the flue gas channels with horizontal connecting channels. The horizontal connecting channels may then be of an arbitrary configuration. The horizontal connecting channels between the flue gas channels may also be controllable.

The inventive vertical connecting channels between the flue gas channels and secondary air ducts, too, may be of an arbitrary configuration. Hence, it is possible to guide the connecting channels vertically into the flue gas channels. But it is also possible to guide the vertical channels in an elevated, inclined or chamfered configuration into the flue gas channels. It is important to allow for a controlled flow of gas from the secondary air ducts into the flue gas channels.

The vertical connecting channels can also be positioned arbitrarily at the flue gas channels or secondary air ducts. Preferably, the vertical connecting channels connect the flue gas channels and the secondary air ducts at regular distances. It is particularly favorable to position the vertical connecting channels at regular distances from the laterally entering "downcomer" channels at the flue gas channels. This enables a particularly good and intimate mixing of partly burnt coking gases with secondary air. A particularly favorable distance of the vertical connecting channels from the laterally entering "downcomer" pipes is a distance of 0 to 1 meter.

Even the type and number of secondary air ducts may vary. For example, even a second secondary air duct comprised of several sole flues and openings may be located under a first secondary air duct comprised of several sole flues and openings. The secondary air ducts can also be laid individually or in a multiple configuration with an external opening. The secondary air ducts, too, can be connected among each other or be connected in a controllable manner. This can be designed as a simple or multiple configuration. The secondary air ducts can be provided in arbitrary quantity and arbitrary combination. The secondary air ducts can be provided with a flap or a valve at the outer air intake to act as a facility which controls the admission of air.

It is possible, for example, to guide several or many individual secondary air ducts under the flue gas channel, thereof each individual channel being connected to the flue gas channel(s), while the secondary air ducts are not connected among each other. It is also possible to install only secondary air ducts which are connected individually and not among each other to the flue gas channels, whereof however only one is controllable. Finally it is also possible to install secondary air ducts which are connected among each other in arbitrary combination and connected in arbitrary combination to the flue gas channels, whereof an arbitrary number is controllable.

The vertical connecting channels between the flue gas channels and secondary air ducts for execution of the inventive device are controllable in gas flow. However, it is also possible to position the facility for controlling the connecting channels not directly in these, but in the secondary air ducts underneath the entrance cross-section of the relevant vertical connecting channel arranged there above.

Finally, the controlling facility may be of a different type and/or configuration. For example, a simple controlling facility is a slide brick which is embedded in the brickwork. Depending on the degree of aperture, it can be embedded in the channel which is passed through by gas. It is also feasible to utilize a sliding brick wall projection or a metal flap. The metal flap should preferably be made of an ultra-high heat-resistant metal. However, the controlling facility can also be fabricated from a pipe section which takes-up the flow of gas in open position and which can be turned about an axis orthogonally to the gas flow, thus reducing the gas flow. It is turned depending on requirements, and with a full turn the gas flow is shut-off. Also suitable is a ball valve cock inasmuch as it can be implemented at these high temperatures.

It is particularly advantageous to use a tabouret (hump) structure embedded in the connecting channels between secondary air duct and flue gas channel. The tabouret is seated in a projection of the connecting channel between the secondary air duct and the flue gas channel. An opening with a flap is embedded in the tabouret. Depending on the degree of aperture, it can be pulled forward or pressed into the opening. But the tabouret can also be moved horizontally in the secondary air duct itself in order to influence the gas flow into the vertical connecting channels and, thereby, into the flue gas channels. For example, it is possible to provide the tabouret with an opening centrally arranged in the tabouret plate. With a full opening of the gas flow, the central opening is slid under the branch from the vertical connecting channel. To shut-off the flow of gas, the tabouret is then slid with the closing tabouret plate under the branch.

The control of the adjusting facility can be configured in different kinds. In a simple configuration, it is a metal rod affixed to a suspension at the wall brick or tabouret. By moving the metal rod, the wall brick or tabouret can then be slid, depending on the desired flow of gas. A channel accommodating the metal rod for guidance is provided in the brickwork in the coke chamber floor next to or above the secondary air ducts.

But the adjustment facility can also be connected with a rope or a chain which is supported in a heat-resistant arrangement and provided with an actuating mechanism via return pulleys, for example. However, it is also feasible to utilize a rod and bar linkage. It is preferably designed and built as an ultra-high heat-resistant device. To guide the controlling device, the coke oven chamber floor is preferably provided with channels which are located next to the run of one secondary air duct. Located therein are rope tackles or the rod and bar linkage. Apart from the controllable inventive connecting channel, the guide channel is then comprised of a ramification through which the controlling device can be actuated.

Eventually the controlling device can also be so designed and built that the ceiling of the flue gas channels is designed in the form of sliding refractory segments. These segments can be slid so that the position of the aperture is then shifted into the flue gas channels. Under these segments there may be bulges by way of which the secondary air duct is better covered. This embodiment is particularly suitable if the apertures are regulated only prior to commissioning. The bricks covering the secondary air ducts are then laid prior to commissioning into the desired position. For this purpose, the front-end side cover of the flue gas channels can also be removed.

It is possible to provide the vertical connecting channels upstream and downstream of the controlling device with nozzle jets or twisting elements by means of which the flow of gas can be better mixed. However, devices designed to slow-down the flow of gas and utilizing a congestion of the gas flow are also suitable.

The coke oven chamber oven equipped with the inventive controlling device can be of any arbitrary type. Preferably it is a coke oven of the "Non-Recovery" or "Heat-Recovery" type. It can be equipped with an arbitrary system of a secondary air heating. The flue gas channels can be guided in a meander-like arrangement or in an arrangement equipped with longitudinally arranged cross connections under the coke oven chamber. The flue gas channels can also be guided transversely and be equipped with longitudinal connections. The waste air chimney drafting air from the flue gas channels or the nozzle connected thereto can be located at the flue gas channels at any arbitrary position. The "downcomer" channels can also be located at an arbitrary position. For example, they can be laterally installed. Even the number of "downcomer" channels may vary. For example, the number of downcomer channels may be 6 or more. But it may also be just one or 2 "downcomer" channels.

The present invention also relates to a method by means of which coal is carbonized in a horizontal coke oven chamber, wherein

- primary air is admitted into the coke oven chamber through an opening existing in the upper section of the coke oven chamber and by which part of the gases evolving on coal carbonization is burnt, and
- the partly burnt gases are conducted via "downcomer" channels into flue gas channels located under the coke oven chamber, and
- further air, i.e. the so-called secondary air, is collected in secondary air ducts located under the flue gas channels and passed from there through a vertical connecting channel or channels into the flue gas channels, and the partly burnt gases are intimately mixed with the secondary air in the flue gas channels and completely burnt, thus heating the coke oven chamber from below, and which is characterized in that at least one vertical connecting channel between the flue gas channels and the secondary air ducts is provided with a facility by way of which the gas stream between the flue gas channel and secondary air duct can be calibrated and regulated.

In a simple configuration type, the controlling facility is actuated only at the beginning of commissioning. Such an actuation is rendered feasible, for example, by manual sliding of recesses in the brickwork or loose wall bricks in the coke oven floor. It is also feasible to control the wall bricks with a rod and bar linkage through channels lying in the coke oven chamber floor next to the secondary air ducts. Also conceivable is the use of a chain which pulls flaps in tubes on or off, depending on the desired degree of aperture. Finally it is also possible to provide a pneumatically actuated controlling facility for the inventive connecting channels. Temperature-resistant air ducts will then be provided for this purpose in the coke oven chamber floor.

The controlling facilities for the inventive vertical connecting channels can be actuated both manually and electrically. For simple devices, rod and bar linkages which can be operated manually may then become eligible, for example. For instance, this can be done once at the beginning of a carbonization process. But it can also be carried out at the beginning of commissioning or continually during a carbonization cycle. In a particularly efficient, though extensive embodiment, the actuating devices are operated electrically and controlled by an automated system. For example, this may be a process control system. For this purpose, measuring probes may be mounted in the secondary air ducts, flue gas channels or in the inventive connecting channels to determine appropriate control parameters. For example, these may be sensors for measuring the temperature, pressure or oxygen content in combustion gas.

The oxygen content in flue gas channels by which the coke oven batteries are heated can accordingly be well controlled via the inventive channels. The portion of oxygen in the combustion gas can be defined as a Lambda value (λ-Wert). With a stoichiometric oxygen ratio, the Lambda value of a combustion amounts to 1. With a sub-stoichiometric oxygen ratio (less oxygen in air than needed for combustion), the Lambda value amounts to less than 1, and with an over-stoichiometric ratio (more oxygen in air than needed for combustion), the Lambda value exceeds 1. In the oven free space above the coke cake, the Lambda value ranges between 0.3 and 0.8, if the present invention is properly implemented. Coking gas is burnt only incompletely. In secondary sole chambers where substantial secondary air is supplied, the Lambda value should range between 1.0 and 1.7. In this manner, an optimal exploitation of the coking gas is achieved for the production of carbonization heat.

The device described hereinabove affords the benefit of an efficient control for the supply of secondary air into the flue gas channel. The present invention can be applied in a multitude of conceivable variants for execution. Conceivable is a very sophisticated and challenging configuration with measuring, controlling and regulating systems as well as a simple configuration with a rod and bar linkage and wall bricks. By application of the device described hereinabove and by applying the method for ventilation of flue gas channels of coke oven chambers, the temperature distribution within a coke oven chamber can be configured very evenly, above all in conjunction with a measuring and controlling system for the carbonization process. The inventive device and the method associated therewith also allow for optimizing the pressure conditions in the flue gas channel and for optimizing the flame distribution. Thereby, the coking coal is much better exploited, while coke quality is optimized, too.

The inventive device is elucidated by way of six drawings, with these drawings just representing examples of embodiments for the design of the inventive device.

DETAILED DESCRIPTION OF THE INVENTION

Figure 1:
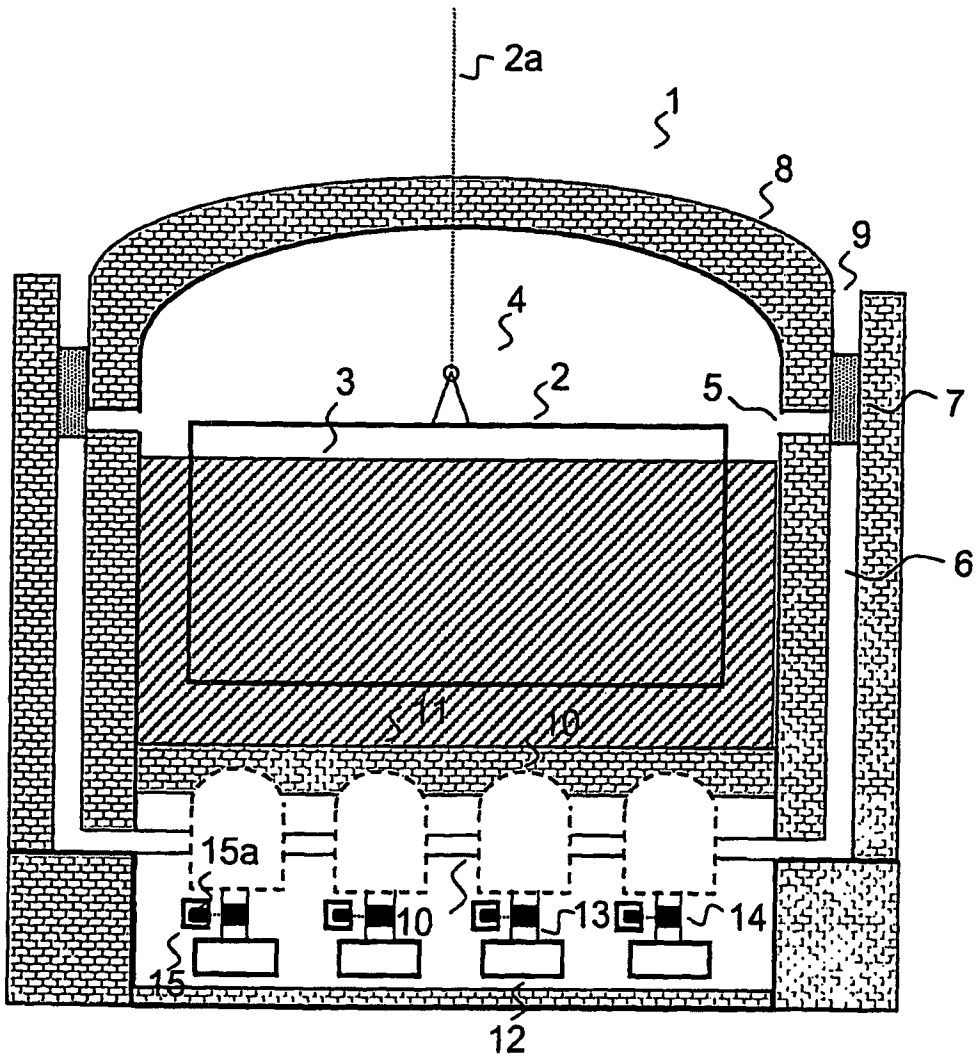
FIG. 1 and FIG. 2 show a horizontal coke oven chamber in a front view.

FIG. 1 shows a horizontal coke oven chamber (1), whose front-end opening is closed by the coke oven chamber door (2) with an opening mechanism (2*a*). The coke cake (3) below is indicatively shown. Located above the coke cake (3) is the oven free space (4). Coking gases may accumulate there. Through a lateral opening (5), the coking gases are conducted into the "downcomer" channels (6). It is possible to install a controlling facility (7) between the lateral opening (5) and the "downcomer" channels (6). Likewise, an opening (9) for supplying additional air may be located at the coke oven ceiling (8). The coking gases are conducted through the "downcomers" (6) and further on into the flue gas channels (10). The complete combustion of coking gases with secondary air occurs there. Located above the flue gas channels (10) is the coke cake (3), which is heated by combustion in the flue gas channels (10) through the coke oven chamber floor (11). The flue gas channels can be connected to each other via horizontal connecting channels (10*a*). Secondary air for complete combustion of the coking gases is supplied through the secondary air ducts (12) located underneath the flue gas channels (10). The secondary air ducts (12) are comprised of openings to the front which can be controllable or non-controllable. Air streams through this opening into the secondary air ducts. From the secondary air ducts, air streams via vertical connecting channels (13) into the flue gas channels (10). According to the present invention, at least one of these connecting channels is equipped with a regulating facility (14). The drawing shows all connecting channels with a controlling facility. Next to the regulating facility (14) for the flow of air, one can see the control device (15). In this case, it is shown as a rod and bar linkage (15*a*) in a control channel (15). A precisely regulated combustion with secondary air will then occur in the flue gas channels.

Figure 2:
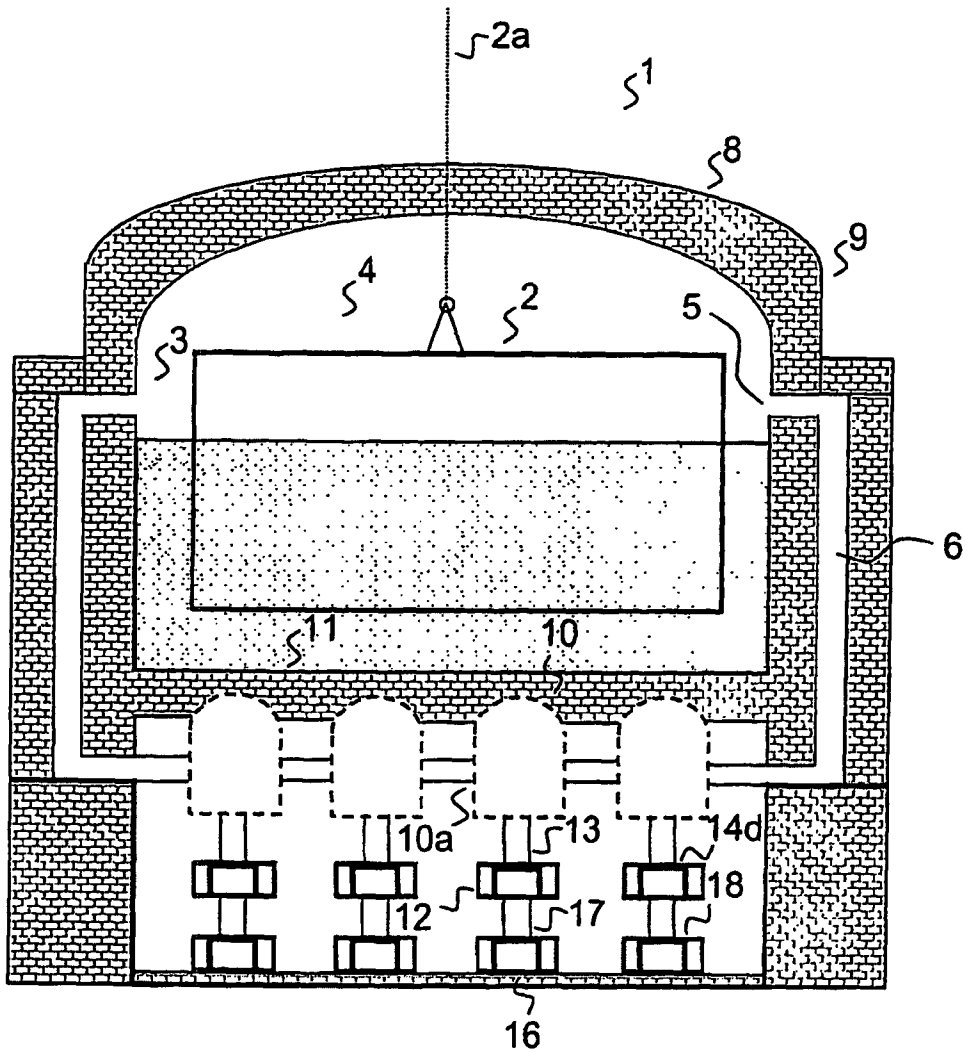

FIG. 2 shows a horizontal coke oven chamber (1) in a front view, too. In addition to the coke oven chamber shown in the first drawing (FIG. 2), this coke oven chamber (1) is provided with further secondary air ducts (16) under the first secondary air duct arrangement (12). These can be connected with the first secondary air duct arrangement (12) through vertical channels (17) and be comprised of regulating facilities (14*d*, 18). Here, the controlling devices are designed and built as a hump-like devices that can be shifted.

Figure 3:
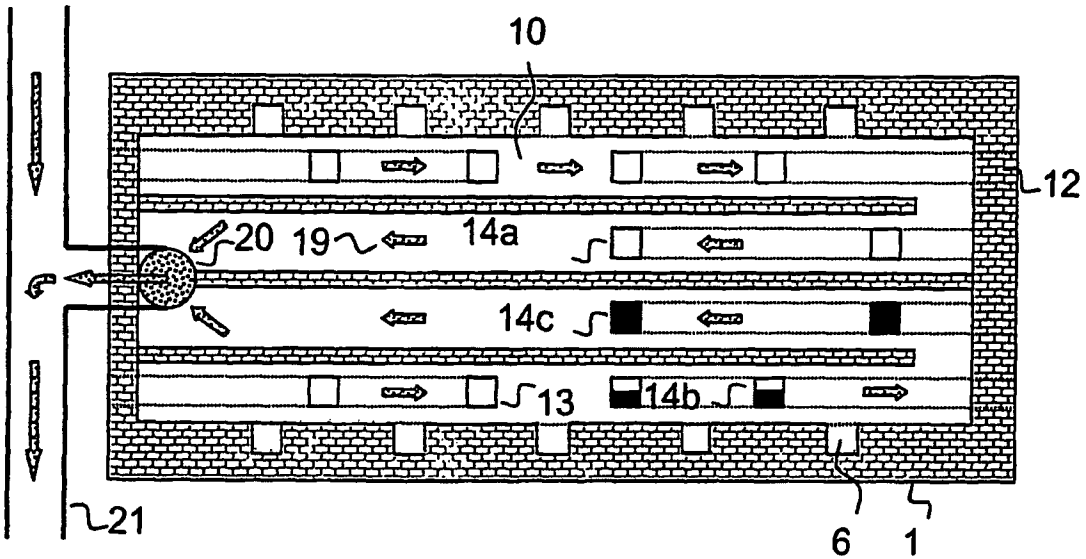
FIG. 3, FIG. 4 and FIG. 5 show a flue gas channel as a sectional view under the coke oven chamber floor in a view from above.

FIG. 3 shows the flue gas channel arrangement of a coke oven chamber (1) in a top view, extending like a meander under the coke oven chamber floor to optimize heating. Secondary air comes from the secondary air ducts lying under the drawing plane. It can stream through open (14*a*) or half-open (14*b*) regulating facilities for the flow of air from the secondary air ducts. This is not possible through closed (14*c*) regulating facilities. The partly burnt coking gas comes from the laterally arranged "downcomer" channels (6). The flue gas stream (19) is conducted through a collecting pipe or channel (20) into the flue gas stack (21).

Figure 4:
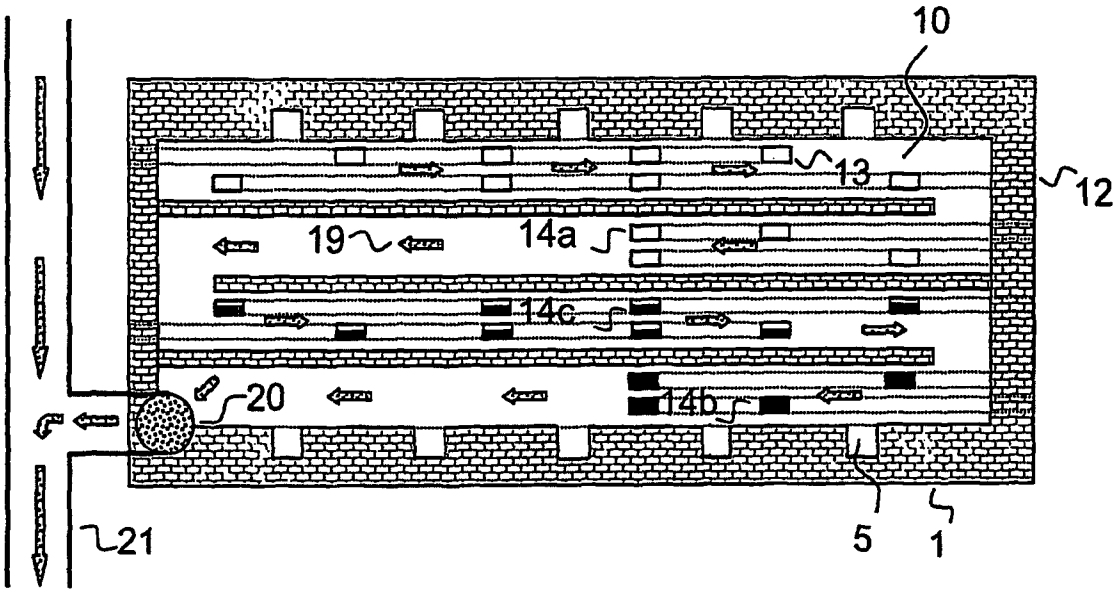

FIG. 4 shows the flue gas channel arrangement (10) of a coke oven chamber (1) in a top view, extending like a meander under the coke oven chamber floor to optimize heating. Secondary air comes from the secondary air ducts (12) lying under the drawing plane, and in this case secondary air is conducted from both sides to various points over the entire length of the flue gas channel. There is a multitude of vertical connecting channels to the flue gas channel for each secondary air duct, with said connecting channels being controllable here individually at many positions. Some of the regulating facilities are open (14*a*), others are half-open (14*b*) and others are closed (14*c*). The connecting channels can virtually be installed in any combination or quantity in the flue gas channels. The partly burnt coking gas comes from the laterally arranged "downcomer" channels (6). The flue gas stream (19) is conducted through a collecting pipe (20) into the flue gas stack (21).

Figure 5:
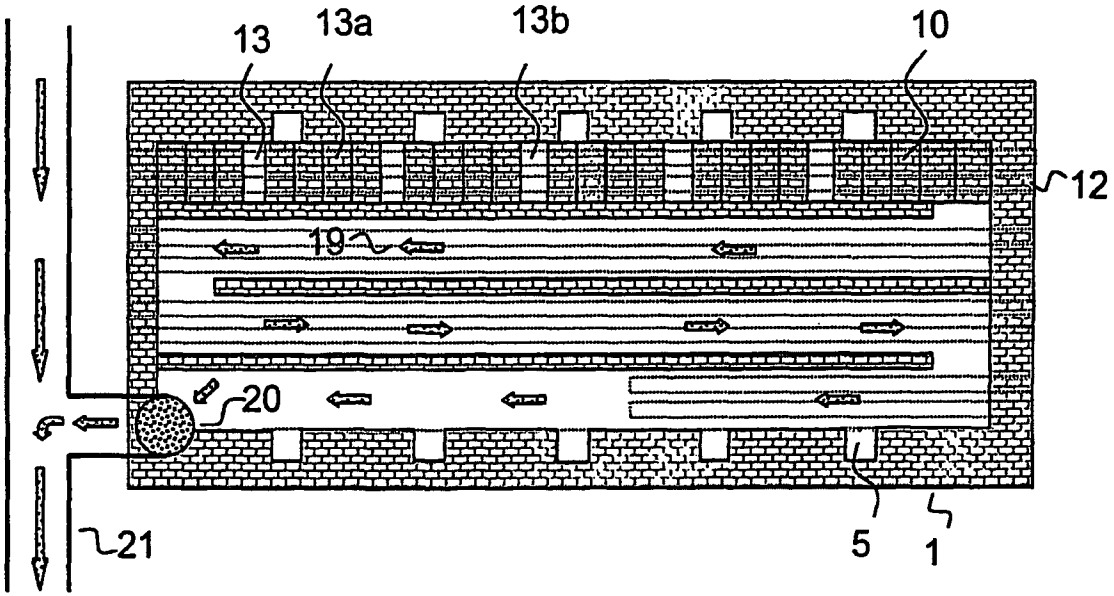

FIG. 5 shows the flue gas channel arrangement (10) of a coke oven chamber (1) in a top view which extends like a meander under the coke oven chamber bottom to optimize the oven heating. The secondary air ducts (13) are covered towards the top by segments (13*a*) in the form of bricks. Only those openings (13*b*) which secondary air is to flow through into the flue gas channels (12) are kept clear. These openings represent the controlling units of the vertical connection ducts. The segments can be bulged-out towards the bottom in order to achieve a better sealing. Moreover, the segments can be equipped with suspensions at their top to allow shifting.

Figure 6:
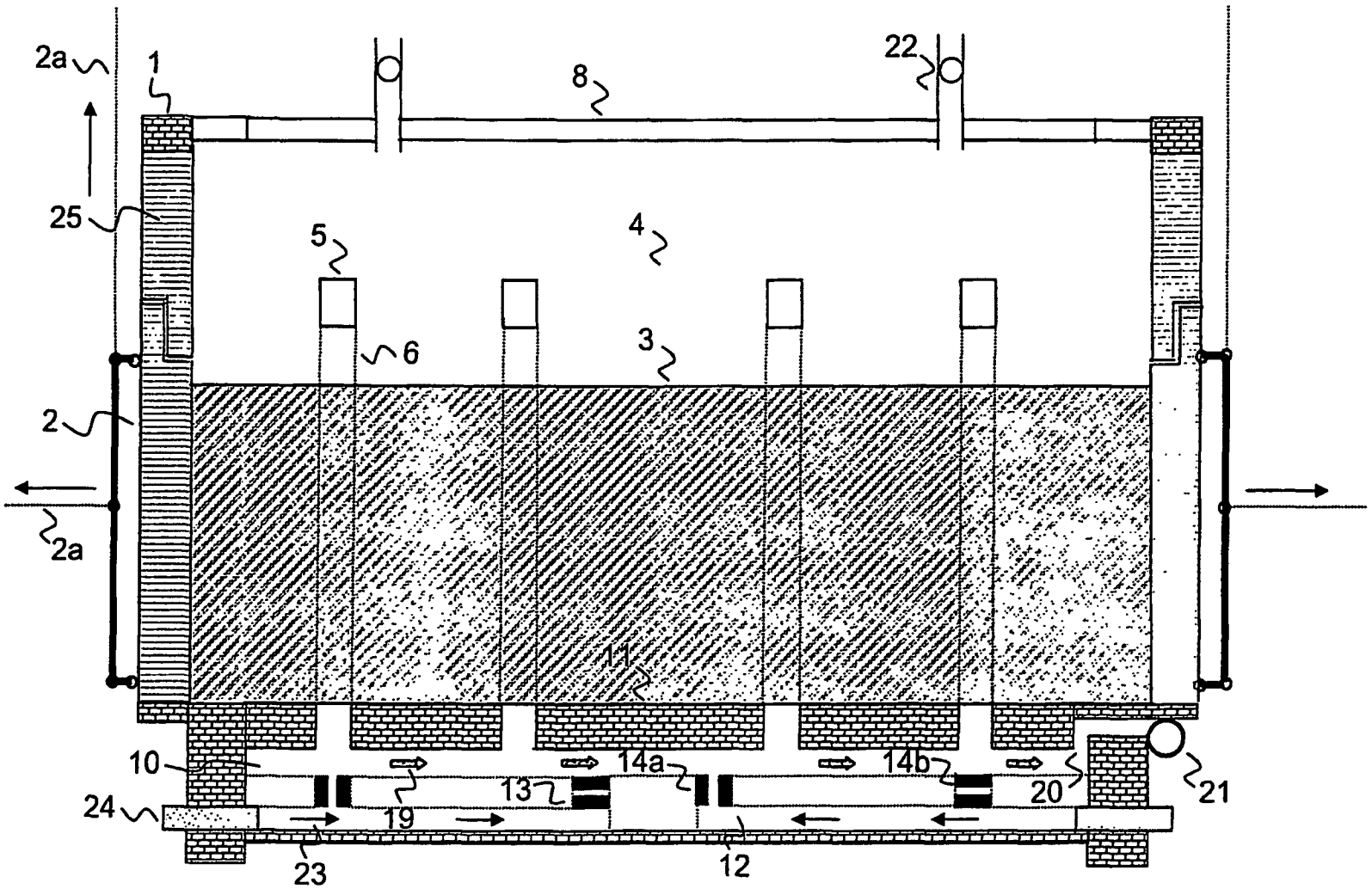
FIG. 6 and FIG. 7 show a horizontal coke oven chamber in a lateral view.

FIG. 6 shows a horizontal coke oven chamber (1) in a lateral view. The carbonization of the coke cake (3) is realized in the coke oven chamber. The coking gases stream into the oven free space (4) above the coke cake (3). Upon a partial combustion with primary air admitted here through openings in the coke oven chamber ceiling (22), the partly burnt coking gas streams through lateral openings (5) in the coke oven chamber wall into the "downcomer" channels (6). These conduct the partly burnt coking gas downwardly into the flue gas channels (10) for complete combustion. The secondary air (23) needed for this purpose streams from the environment through openings (24) which may be controllable into the secondary air ducts (12). From the secondary air duct, the secondary air is conducted via vertical connecting channels (13) into the flue gas channels (10). Mounted in the vertical connecting channels (13) is the regulating facility shown here in open (14*a*) or closed (14*c*) status. By way of the controllable vertical connecting channels (13), the heat distribution at the coke oven chamber floor (11) can be configured more evenly and combustion in flue gas channels (10) can be better controlled. The flue gas stream (19) is conducted through a flue gas collecting pipe (20) into the flue gas stack (21).

Figure 7:
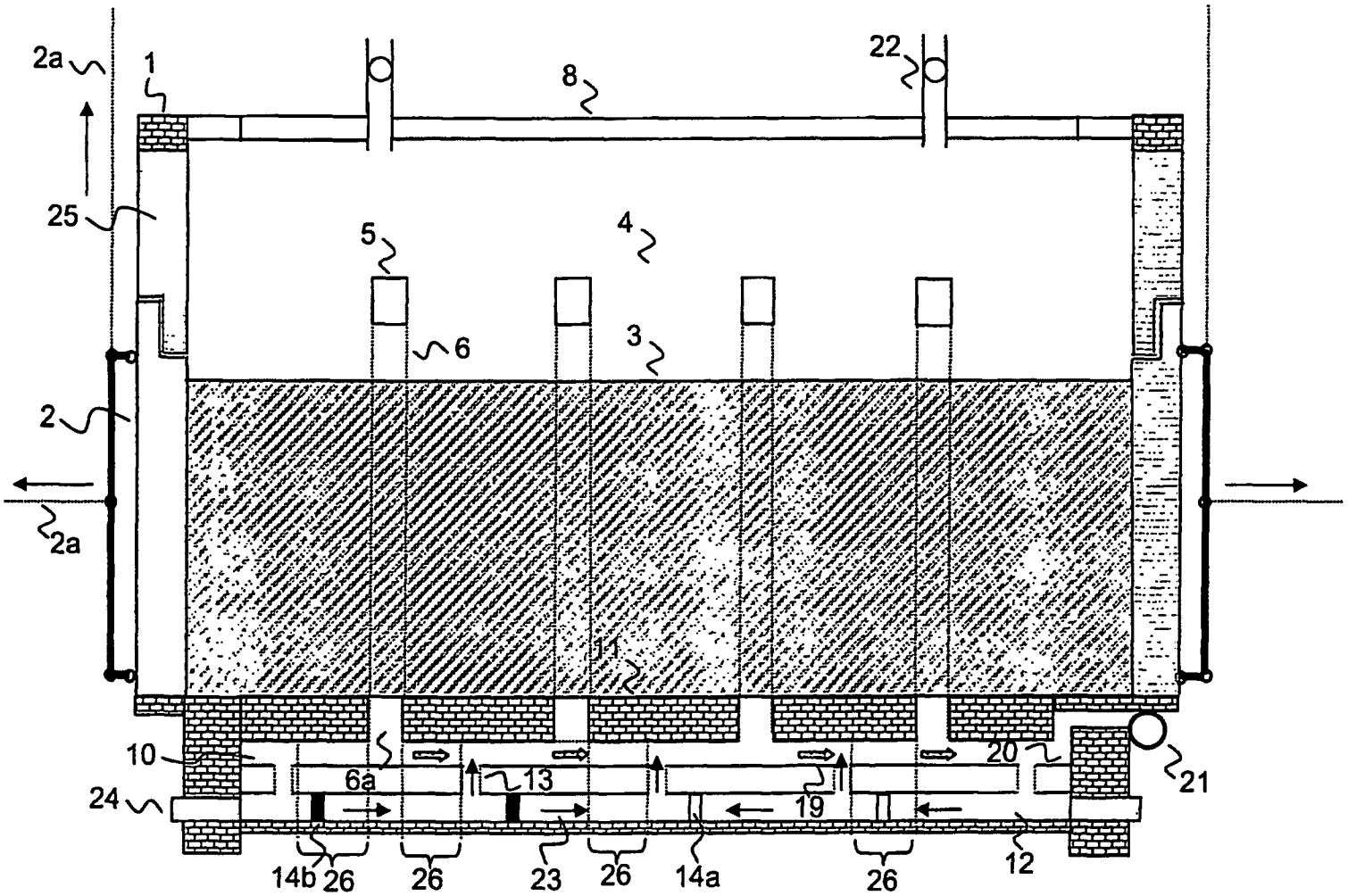

FIG. 7 shows a horizontal coke oven chamber (1) in a lateral view. The lead-in terminal of the vertical connecting channels into the flue gas channels is again elucidated here. The lead-in terminal of the vertical connecting channels into the flue gas channel is realized within regular distances (26) from the lateral lead-in terminals (6*a*) of the "downcomer" channels (6). The lateral lead-in terminals of the vertical connecting channels (13) from the secondary air ducts into the flue gas channel are preferably located at a distance of 0 to 1 m (26) from the lateral lead-in terminals (6*a*) of the "downcomer" channels.

Figure 8:
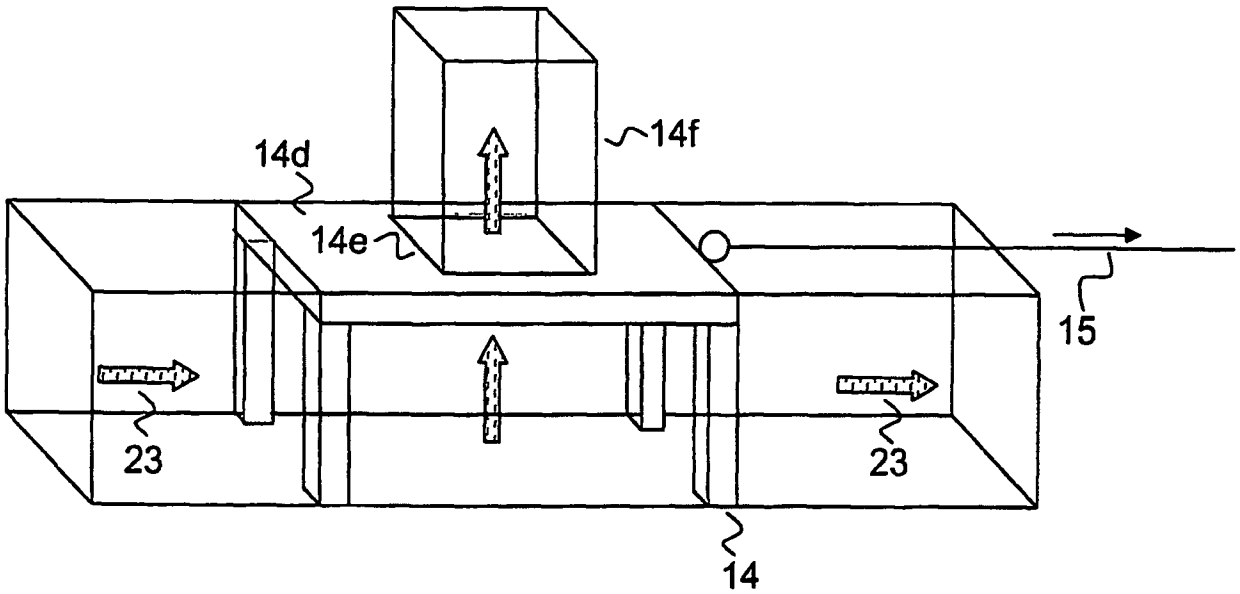
FIG. 8 and FIG. 9 show a controlling facility for the connecting channels between the flue gas channel and the secondary air duct.

FIG. 8 shows an inventive device for regulating the air flow between the secondary air ducts and the flue gas channels. The device for regulating in this case is configured as a hump-like (tabouret) facility which has an opening (14*e*) located centrally in the middle of the tabouret plate (14*d*). Here the device is shown in open status. The passage of air is possible only through the opening (14*e*). For closing, the tabouret is pulled with the tabouret plate over the branch to the vertical connecting channel (14*f*). For example, it is a chain linked via return pulleys to a traction mechanism. Traction is realized, for instance, with a rod and bar linkage (15*b*) fastened to the tabouret.

Figure 9:
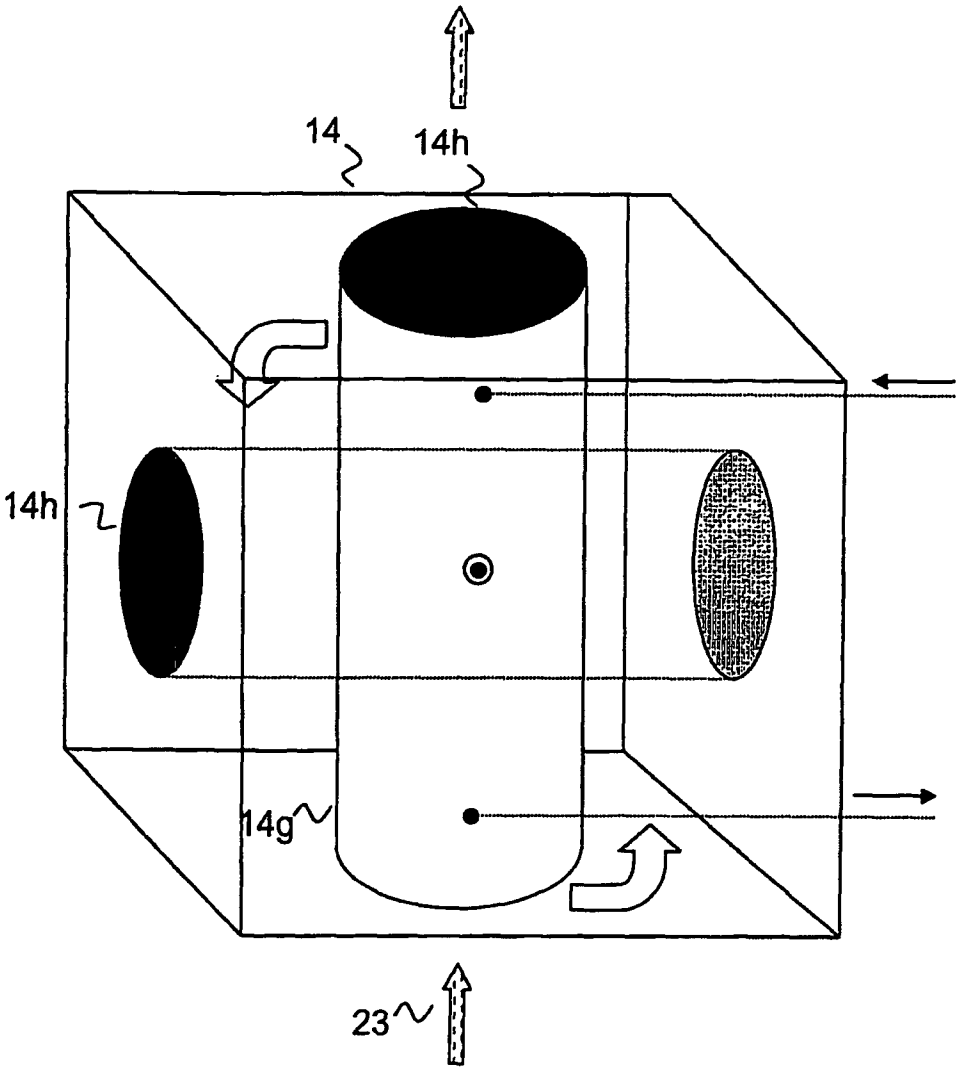

FIG. 9 shows an inventive device for regulating the air flow (14) between the secondary air ducts and the flue gas channels. Here the device is configured like a pipe section (14*g*) which is turned to regulate the gas flow. In the open position, gas streams through the cross-section of the pipe piece (14*h*). By way of the turning movement of the pipe piece in horizontal direction, the cross-section of the gas flow is more and more contracted until the flow of gas is finally blocked entirely.

Figure 10:
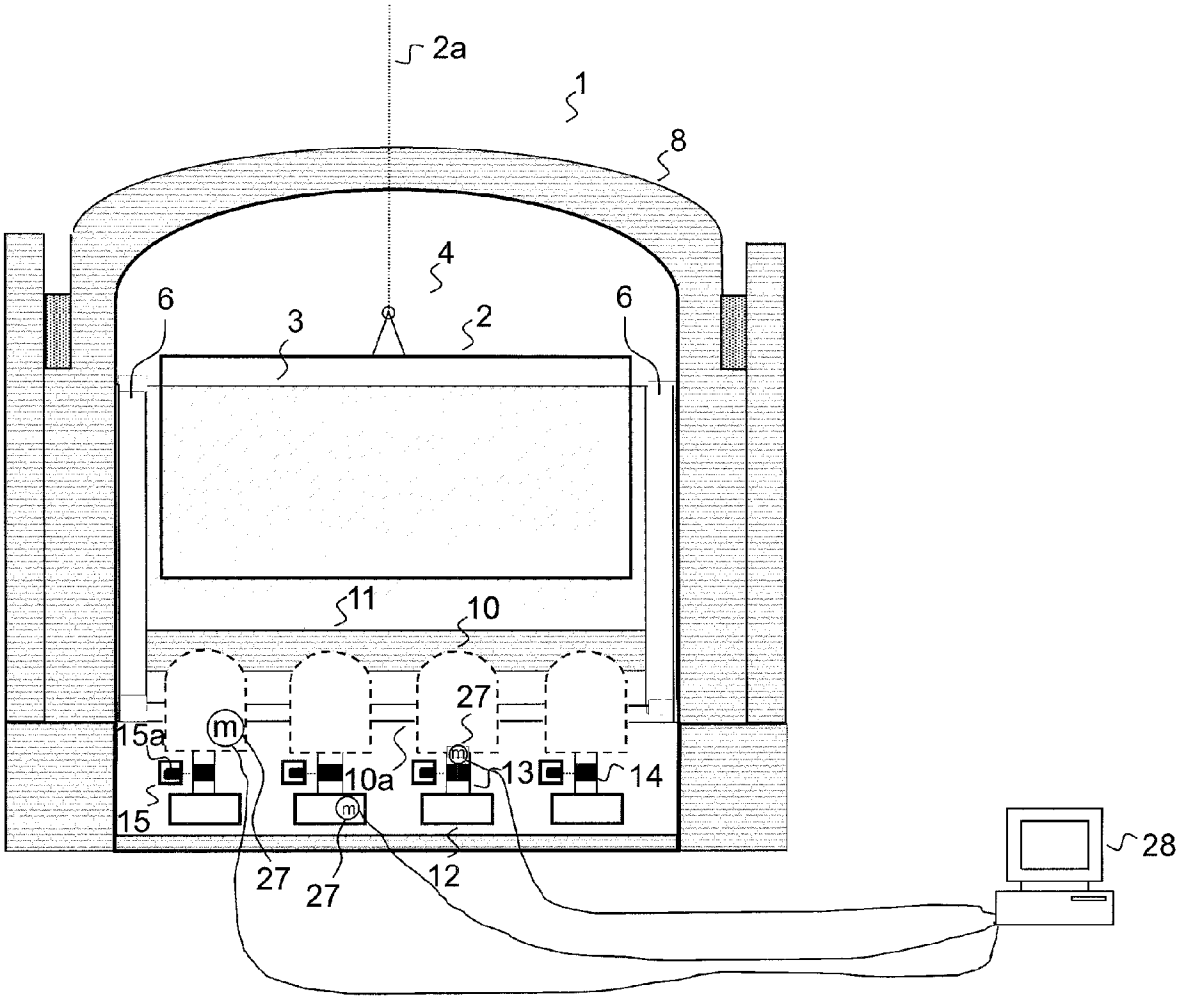
FIG. 10 and FIG. 11 show additional detail of an embodiment of a horizontal coke oven chamber in a front view.

FIG. 10 illustrates the location of the measuring devices 27 connected to a control 28.

Figure 11:
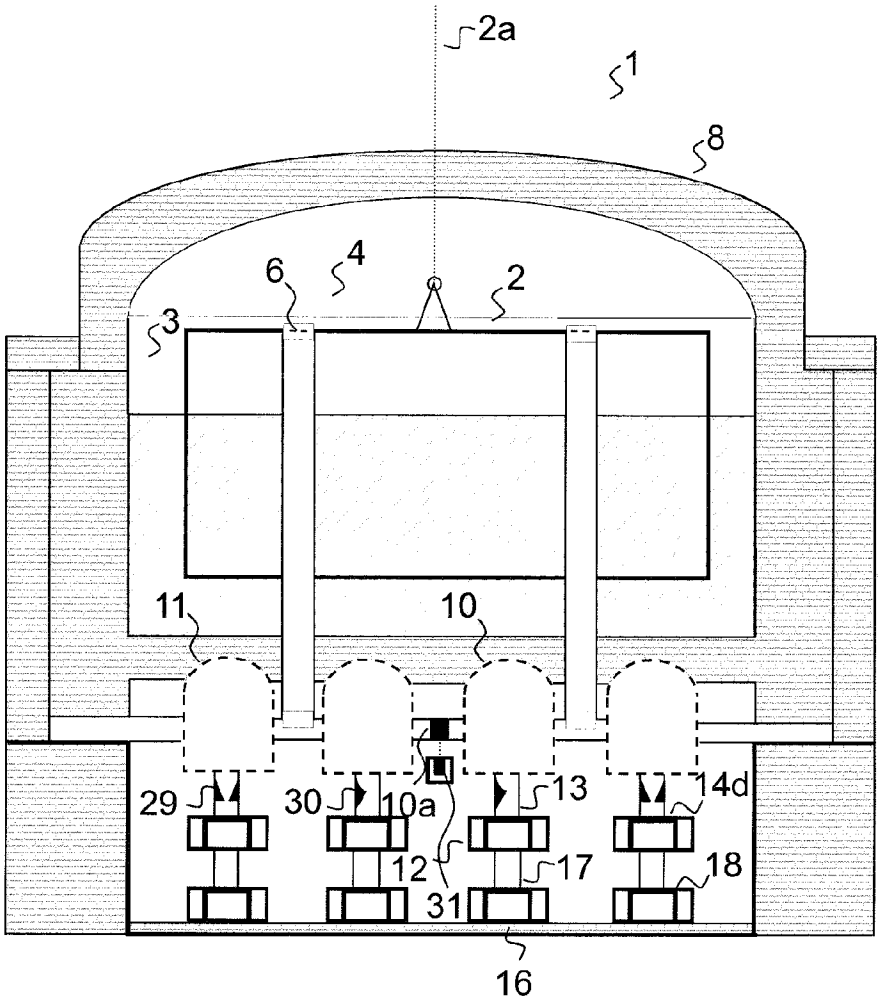

FIG. 11 shows the downcomer through the coke cake, the position of the nozzle jets or twisting elements (29, 30) and a control device (31) located in the horizontal connecting channels (10*a*) between the flue gas channels so that the horizontal connecting channels may also be controllable.

LIST OF REFERENCE SYMBOLS

1 Coke oven chamber
2 Coke oven chamber door
2*a* Moving device for coke oven chamber door
3 Coke cake
4 Oven free space
5 Lateral openings for coking gases
6 "Downcomer" channels
6*a* Lateral lead-in terminal of "downcomer" channels
7 Regulating facility for gas flow into "downcomer" channels
8 Coke oven chamber ceiling
9 Opening for additional primary air
10 Flue gas channel
11 Coke oven chamber floor
12 Secondary air ducts
13 Connecting channels for secondary air ducts with flue gas channels
13*a* Brick segments to cover the flue gas channels towards the bottom
13*b* Openings to connect the secondary air channels towards the top
14 Regulating facility for connecting channels
14*a* Opened regulating facility for connecting channels
14*b* Semi-closed regulating facility for connecting channels
14*c* Closed regulating facility for connecting channels
14*d* Tabouret as regulating facility in secondary air duct
14*e* Opening in tabouret
14*f* Ramification from vertical connecting channel
14*g* Pipe section as a device for shutoff
14*h* Cross-section of the pipe section

15 Control of the regulating facility for connecting channels
15*a* Control of the regulating facility
15*b* Chain for opening or closing
16 Arrangement of further secondary air ducts
17 Vertical connecting channels between secondary air ducts
18 Regulating facility for connecting channels between secondary air ducts
19 Flue gas stream
20 Collecting pipe for flue gases
21 Flue gas stack
22 Controllable openings for primary air in the oven ceiling
23 Secondary air stream
24 Flaps for admission of secondary air into the secondary air duct
25 Lateral coke oven chamber wall
26 Distance between connecting channels and "downcomer" channels

The invention claimed is:

1. A device for carbonization of coal in a horizontal coke oven chamber comprising:

a horizontal coke oven chamber with openings in its upper part for admission of primary air by which part of the gases occurring during coal carbonization is burnt, and at least one flue gas channel closed towards the exterior which is located underneath the coke oven chamber floor which collect(s) partly burnt gases from the carbonization process and burn these completely with secondary air, the coke oven chamber includes downcomer channels for discharge of partly burnt gases from the carbonization process which are integrated in a lateral coke oven chamber wall or in a coke oven chamber door or in the coke cake, with these downcomer channels connecting the coke oven chamber interior with the at least one flue gas channel, secondary air ducts which are located underneath the at least one flue gas channel, said secondary air ducts being connected to atmospheric air and being vertically connected to the at least one flue gas channel by at least one vertical connecting channel and serving for admission of secondary air by which partly burnt gases from the carbonization process are completely burnt, and the at least one flue gas channel which is connected to a flue gas collecting pipe located outside the coke oven, said collecting pipe conducting the flue gases to the exterior atmosphere surrounding the coke oven, wherein the at least one vertical connecting channel between the at least one flue channel and the secondary air ducts is provided with a means for calibrating and regulating the secondary air between the at least one flue gas channel and secondary air duct by which the secondary air can be calibrated and regulated, and wherein the means for calibrating and regulating the secondary air allow a controlled secondary heating.

2. The device as defined in claim 1, wherein further secondary air ducts for better supply of secondary air to the at least one flue gas channel are located underneath or laterally of the secondary air ducts and that the secondary air ducts are connected with the at least one vertical connecting channel.

3. The device according to claim 1, wherein the at least one flue gas channel comprises multiple flue gas channels which are connected among each other with at least one horizontal channel.

4. The device as defined in claim 1, wherein one or more secondary air ducts are individually guided through the coke oven chamber floor and vertically connected with one of the at least one flue gas channels through one channel only which individually admits secondary air into the at least one flue gas channel.

5. The device as defined in claim 4, wherein at least one vertical connecting channel between the individually extending secondary air ducts or the individually extending secondary air ducts is provided with means for calibrating and regulating by which the secondary air flow between the flue gas channel and secondary air duct can be calibrated and regulated.

6. The device according to claim 1, wherein at least one of the secondary air ducts connected through a single channel with the at least one flue gas channel is provided with a device at the air entrance regulating the gas flow.

7. The device as defined in claim 1, wherein the means for calibrating and regulating the secondary air between the at least one flue gas channel and the secondary air duct is comprised of a brick which depending on the desired flow rate is further slid into a gas channel so that the cross-section of the gas channel is reduced or expanded.

8. The device as defined in claim 7, wherein the brick regulating the gas stream is comprised of a suspension device through which a metal rod is guided which is operable from outside the coke oven chamber so that the regulating brick is slid into the gas channel or pulled out from the gas channel, thus making it possible to calibrate and regulate the gas flow.

9. The device as defined in claim 7, wherein the means for calibrating and regulating the secondary air between the at least one flue gas channel and the secondary air duct can be moved with a rope tackle or a rod and bar linkage operable from outside, thus making it possible to regulate the gas flow.

10. The device as defined in claim 7, wherein the means for calibrating and regulating the secondary air between the at least one flue gas channel and the secondary air duct comprises a device for manual operation.

11. The device as defined in claim 7, wherein the means for calibrating and regulating the secondary air between the at least one flue gas channel and the secondary air duct comprises an electric actuator motor and handling structure associated therewith.

12. The device as defined in claim 1, wherein the means for calibrating and regulating the secondary air between the at least one flue gas channel and the secondary air duct comprised of a tabouret which is raised onto a ledge existing in the gas channel and comprised of a gas orifice or gas flap which is slid into the gas flow, thus reducing or expanding the cross-section of the gas channel depending on the desired gas flow rate.

13. The device as defined in claim 1, wherein the means for calibrating and regulating the secondary air between the at least one flue gas channel and the secondary air duct is comprised of a tabouret which is centrally arranged in the tabouret plate and comprised of an opening and which is horizontally moved in the secondary air duct and slid with the tabouret plate into the gas flow of the connecting channel branching-off to reduce or shut-off the gas flow and which for opening is slid with the central opening under the embranchment of the branching-off connecting channel, thus reducing or expanding the cross-section of the branching-off connecting channel depending on the desired gas flow rate.

14. The device as defined in claim 1, wherein the means for calibrating and regulating the secondary air between the at least one flue gas channel and the secondary air duct is comprised of a metallic pipe carrying gas when being in open status, said pipe having an inner pipe which can be rotated about an axis orthogonally to the gas flow and through the rotating movement of which the gas flow is gradually closed or opened.

15. The device as defined in claim 1, wherein the at least one vertical connecting channel comprises several vertical connecting channels.

16. The device as defined in claim 15, wherein the several vertical connecting channels which are located between the at least one flue gas channel and secondary air ducts, are provided with means for calibrating and regulating the secondary air between the at least one flue gas channel and secondary air duct by which the secondary air can be calibrated and regulated.

17. The device as defined in claim 15, wherein the lead-in terminal of the vertical connecting channel(s) into the at least one flue gas channel is configured in elevated, inclined or chamfered arrangement.

18. The device as defined in claim 15, wherein the vertical connecting channels located between the at least one flue gas channel and secondary air ducts terminate at a distance of 0 to 1 m upstream or downstream of the relevant entrance opening of a downcomer channel into the at least one flue gas channel.

19. A method for carbonization of coal in a horizontal coke oven chamber as defined in claim 1, comprising:

admitting primary air into the coke oven chamber through an opening existing in the upper section of the coke oven chamber and by which part of the gases evolving on coal carbonization is burnt, and conducting the partly burnt gases via the downcomer channels into the at least one flue gas channel located under the coke oven chamber, and collecting secondary air in the secondary air ducts located under the at least one flue gas channel and passing it from there through the at least one vertical connecting channel into the at least one flue gas channel, and mixing the partly burnt gases with the secondary air in the at least one flue gas channel and completely burnt, thus heating the coke oven chamber from below, wherein the secondary air from the secondary air duct is conducted through the means for calibrating and regulating in a proportioned dosage into the at least one flue gas channel so that combustion is thereby precisely regulated.

20. The method as defined in claim 19, wherein the inflow of secondary air into the at least one flue gas from the secondary air duct is manually controlled.

21. The method as defined in claim 19, wherein the inflow of secondary air into the at least one flue gas channel from the secondary air duct is electrically or pneumatically controlled.

22. The method as defined in claim 21, wherein the electrical or pneumatic control of secondary air inflow is controlled via a process control system.

* * * * *